US006116798A

United States Patent [19]

Chen et al.

[11] Patent Number: 6,116,798

[45] Date of Patent: Sep. 12, 2000

[54] CLEANING DEVICE WITH A DETERGENT CONTROL STRUCTURE

[76] Inventors: Tsun-Fu Chen; Chin-Kuo Wu, both of P.O. Box 82-144, Taipei, Taiwan

[21] Appl. No.: 09/208,862

[22] Filed: Dec. 10, 1998

[51] Int. Cl.[7] ..... A47L 25/00

[52] U.S. Cl. ..... 401/42; 401/40; 401/139; 401/140; 401/204; 401/205; 401/207

[58] Field of Search ..... 401/40–42, 130, 401/138–140, 204, 205, 207, 263

[56] References Cited

U.S. PATENT DOCUMENTS

| | | | |
|---|---|---|---|
| 2,941,418 | 6/1960 | Esser et al. | 401/40 X |
| 3,039,492 | 6/1962 | Brucker | 401/40 X |
| 3,258,809 | 7/1966 | Harvey | 401/42 X |
| 3,271,809 | 9/1966 | Morawski | 401/42 |
| 4,008,968 | 2/1977 | Hobbs | 401/207 |
| 4,126,401 | 11/1978 | Stoyshin | 401/42 |
| 4,305,224 | 12/1981 | Maddock | 401/205 X |
| 4,961,662 | 10/1990 | Chow et al. | 401/42 |
| 4,966,481 | 10/1990 | Satten et al. | 401/205 |

*Primary Examiner*—Steven O. Douglas
*Assistant Examiner*—Kathleen J. Prunner
*Attorney, Agent, or Firm*—A & J

[57] ABSTRACT

A cleaning device provided with a detergent control structure includes a tube, a connector, a control valve, and a handle. The tube is elongated and has a spray head and a cleaning element at a front end thereof. A rear end of the tube is connected to the handle provided with the control valve. The connector is internally divided into first and second channels and is coupled to a detergent box at a bottom end thereof. The control valve includes a securing block and a rotary block that are respectively provided with two round holes and a round hole. In use, the handle is connected to a water hose to allow input of water. By turning the handle to cause the round hole of the rotary block to align with the first round hole of the securing block and the first channel of the connector, clean water can be ejected from the spray head. If the handle is turned such that the round hole of the rotary block aligns with the second round hole of the securing block and the second channel of the connector, water is allowed to come into contact with the detergent in the detergent box so that a mixture of water and detergent can be ejected from the spray head to assist cleaning.

3 Claims, 5 Drawing Sheets

CLEANING DEVICE WITH A DETERGENT CONTROL STRUCTURE

BACKGROUND OF THE INVENTION

1. Field of the Invention

The present invention is generally related to a cleaning device, and more particularly to a cleaning device equipped with a detergent control structure.

2. Description of the Prior Art

There have been developed cleaning devices equipped with detergent supply structures to assist cleaning. However, these devices are complicated in construction and inconvenient to operate.

Therefore, it is an object of the present invention to provide a cleaning device with a detergent control structure which can obviate and mitigate the above-mentioned drawbacks.

SUMMARY OF THE INVENTION

The present invention is generally related to a cleaning device, and more particularly to a cleaning device equipped with a detergent control structure.

A primary object of the present invention is to provide a cleaning device with a detergent control structure, in which the control of ejection of water and detergent is convenient.

According to the present invention, a cleaning device with a detergent control structure comprises a tube, a connector, a control valve, and a handle. The tube is elongated and has a spray head and a cleaning element at a front end thereof. A rear end of the tube is connected to the handle provided with the control valve. The connector is internally divided into first and second channels and is coupled to a detergent box at a bottom end thereof. The control valve includes a securing block and a rotary block that are respectively provided with two round holes and a round hole. In use, the handle is connected to a water hose to allow input of water. By turning the handle to cause the round hole of the rotary block to align with the first round hole of the securing block and the first channel of the connector, clean water can be ejected from the spray head. If the handle is turned such that the round hole of the rotary block aligns with the second round hole of the securing block and the second channel of the connector, water is allowed to come into contact with the detergent in the detergent box so that a mixture of water and detergent can be ejected from the spray head to assist cleaning.

DETAILED DESCRIPTION OF THE PREFERRED EMBODIMENT

Figure 1:
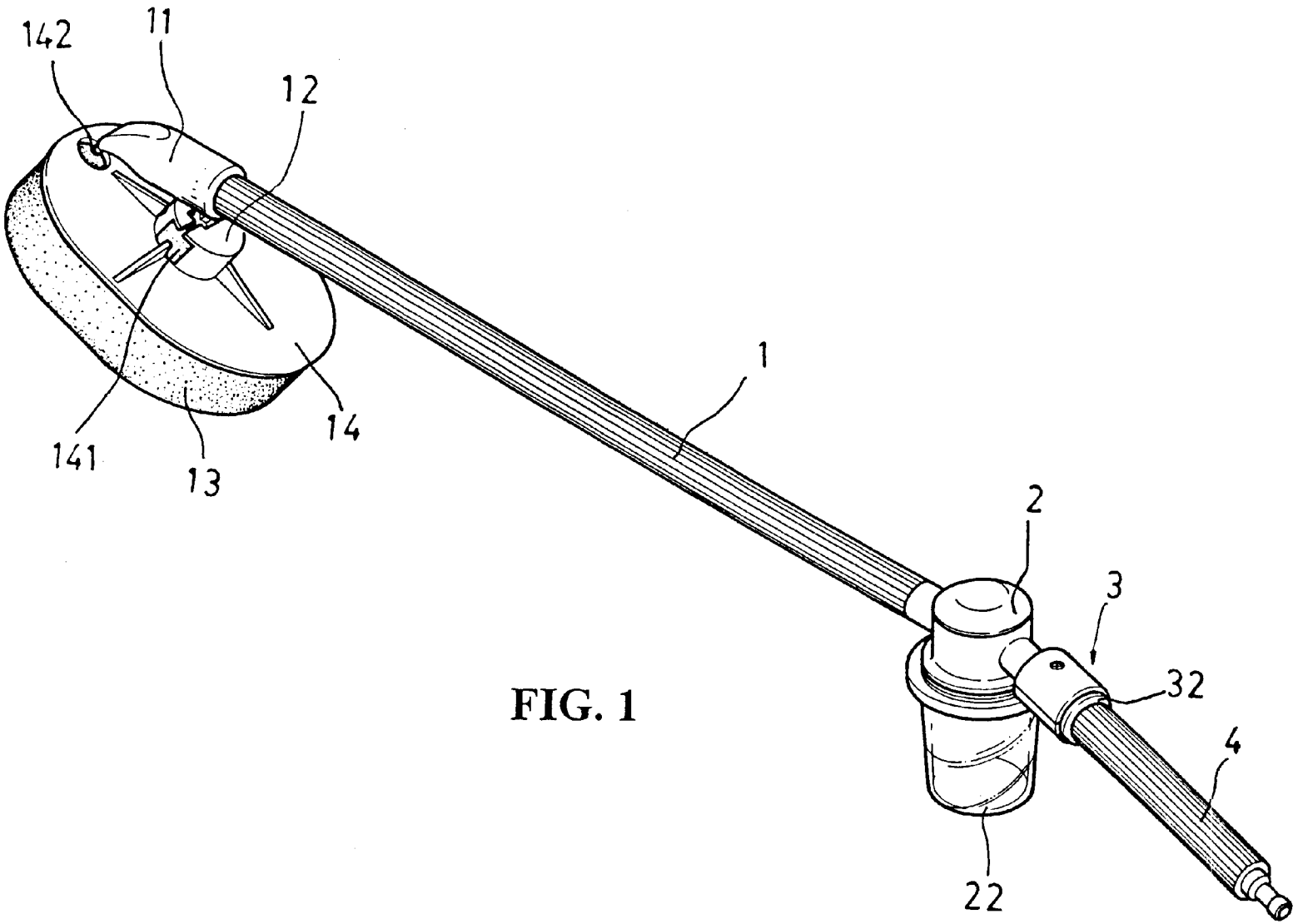
FIG. 1 is a schematic perspective view of the present invention.
Figure 2:
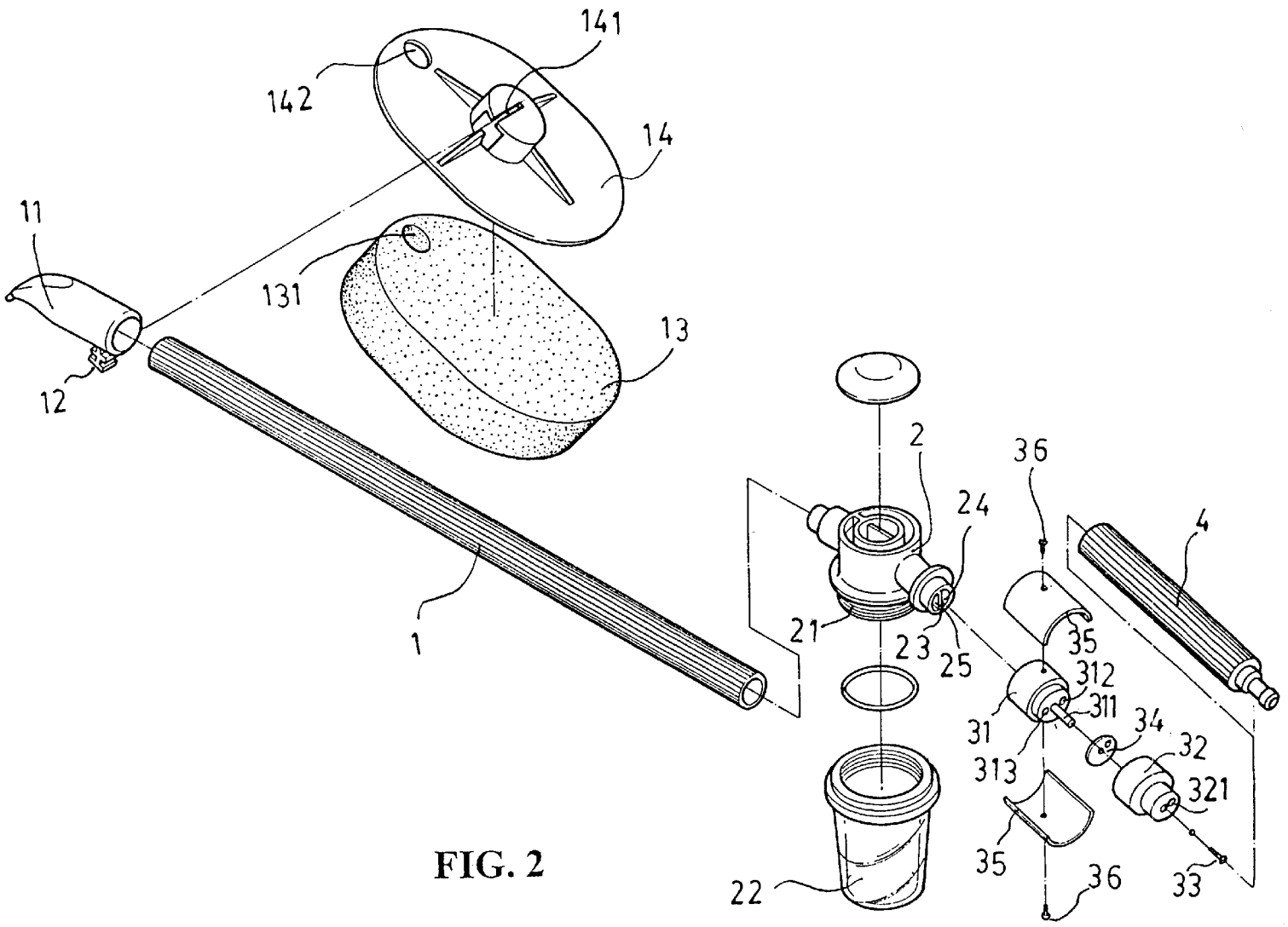
FIG. 2 is a schematic perspective exploded view of the present invention.
Figure 3:
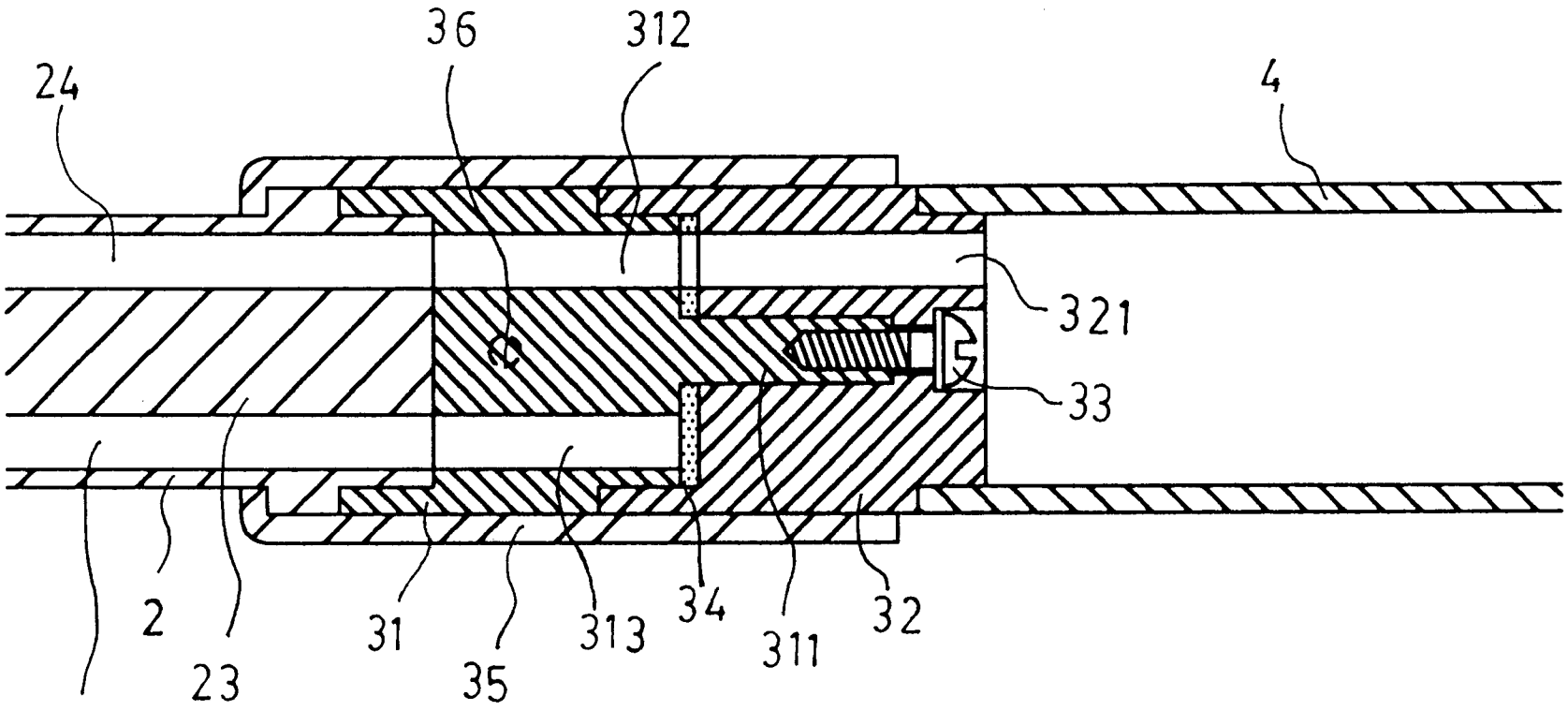
FIG. 3 is a schematic sectional assembled view of the control valve according to the present invention.

With reference to FIGS. 1, 2, and 3, a preferred embodiment of a cleaning device with a detergent control structure according to the present invention essentially comprises an elongated tube 1, a connector 2, a control valve 3, and a handle 4. The tube 1 has a spray head 11 fitted at a front end thereof. The spray head 11 has an I-shaped slide block 12 extending from a lower portion thereof. A plate 14 has a cleaning element 13 adhered thereto and is provided with a slide groove 141. The slide block 12 can be slid into the slide groove 141 so that the cleaning element 13 can be coupled to the lower portion of the spray head 11. The plate 14 and the cleaning element 13 are provided with through holes 142, 131 so that streams of water in the spray head 11 can be ejected through the through holes 142, 131. The connector 2 is substantially circular and has one end fitted to a rear end of the tube 1. The circular connector 2 has a screw portion 21 extending from a lower portion thereof to connect to a detergent box 22 adapted to contain a detergent. The connector 2 is internally provided with a vertically disposed partition plate 23 to divide the interior of the connector 2 into a first channel 24 and a second channel 25. The other end of the connector 2 is connected to the control valve 3. The control valve 3 includes a securing block 31 and a rotary block 32. One end of the securing block 31 is secured directly on the connector 2 using an adhesive. The securing block 31 has a post 311 of a suitable length projecting from the other end to fit into the rotary block 32 that has the same external diameter as the securing block 31, so that the securing block 31 and the rotary block 32 can perform relative rotation. In order to prevent the rotary block from slipping during rotation, a screw element 33 may be passed through the rotary block 32 into the securing block 31. The securing block 31 is further provided with first and second round holes 312, 313, which communicate with first and second channels 24, 25 of the connector 2 respectively. The rotary block 32 is formed with a round hole 321 of a suitable diameter which, when the rotary block 32 rotates, can align with the first round hole 312 or the second round hole 313. In addition, the rotary block 32 has a stepped portion at a rear end thereof. The handle 4 is a hollow structure that has a front end adhered directly to the stepped portion of the rotary block 32, whereby turning of the handle 4 may cause the rotary block 32 to rotate. A rear end of the handle 4 may be connected to a water hose so that water can flow into the interior of the handle 4 and through the control valve 3 and the connector 2. In order to prevent leakage of water from the joint between the securing block 31 and the rotary block 32 during relative rotation, a plastic packing 34 can be disposed between the securing block 31 and the rotary block 32 to achieve water tightness. Additionally, two curved pieces 35 may be secured on the securing block 31 by using securing nails 36 so as to enclose the securing block 31 and the rotary block 32 entirely and to enhance the appearance of the control valve 3.

Figure 4A:
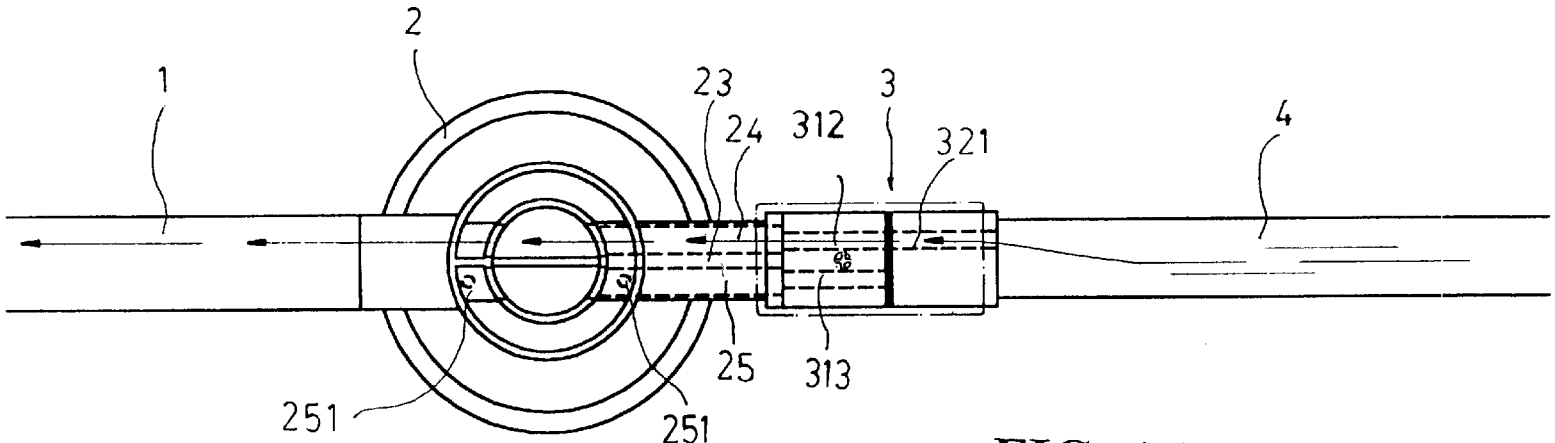
FIG. 4 is a schematic sectional view illustrating the internal structure of the present invention during ejection of clean water.
Figure 4:
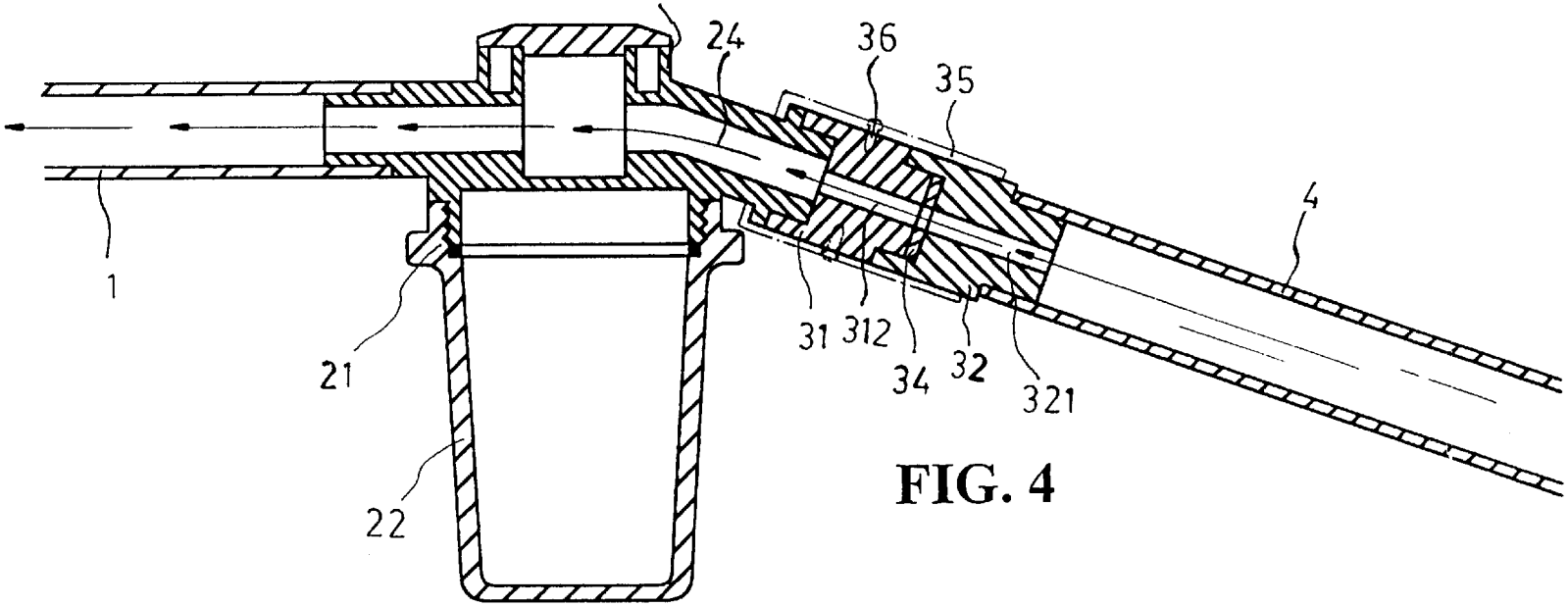

Referring to FIG. 4, in use, the rear end of the handle 4 is connected to a water hose. If the handle 4 is turned so that the round hole 321 of the rotary block 32 is brought into alignment with the first round hole 312 of the securing block 31, then the water can flow through the handle 4 through the first channel 24 of the connector 2 into the tube 1 to be ejected from the spray head 11 as a stream of clear water to assist cleaning using the cleaning element 13.

Certainly, it should be understood that if the round hole 321 of the rotary block 32 is not brought into alignment with the first or second round hole of the securing block 31, water cannot flow into the connector 2.

Figure 5A:
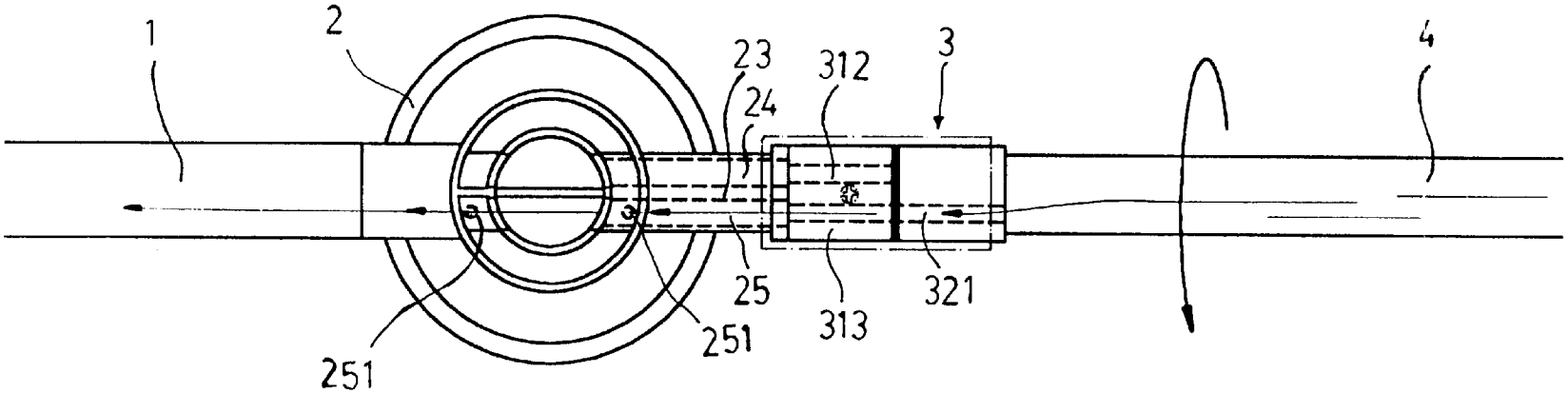
FIG. 5 is a schematic sectional view illustrating the internal structure of the present invention during ejection of a mixture of water and detergent.
Figure 5:
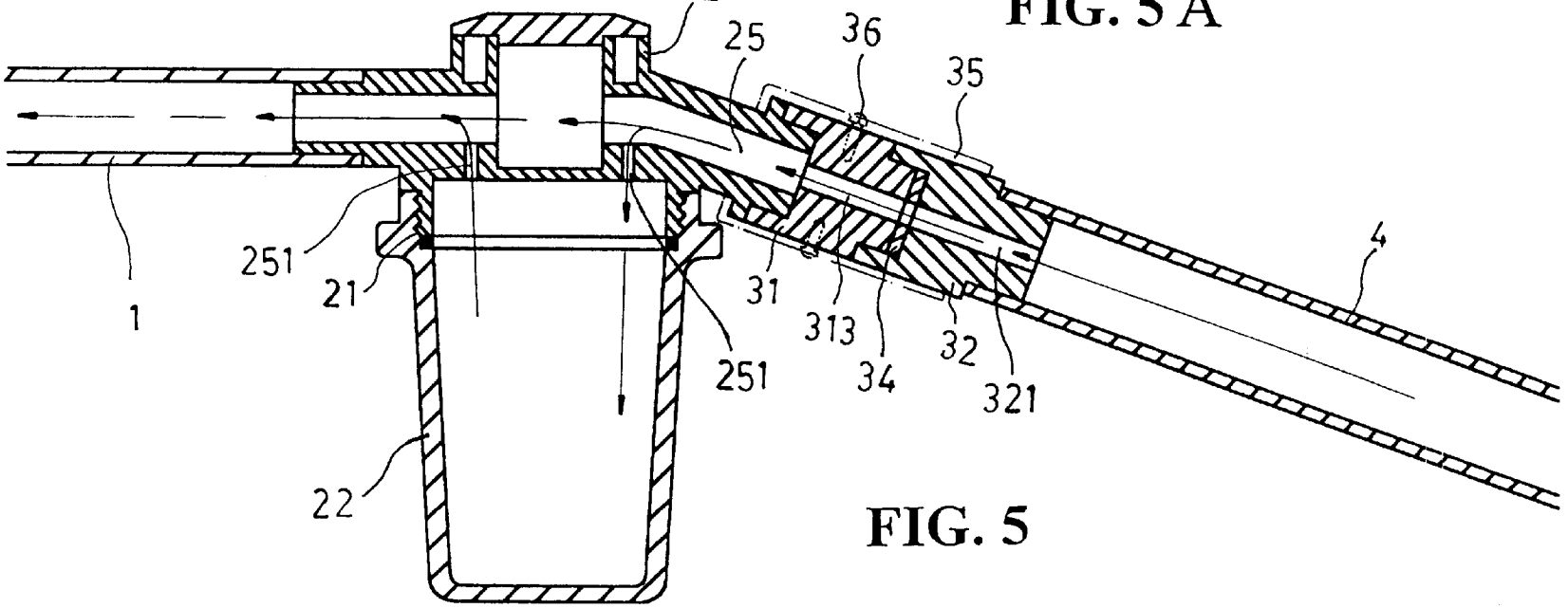

Referring to FIG. 5, if the handle 4 is turned so that the round hole 321 of the rotary block 32 is in alignment with the second round hole 313 of the securing block 31, then water flowing into the handle 4 will flow through the second channel 25 of the connector 2. As the second channel 25 is provided with water holes 251 at front and rear portions thereof that communicate with the detergent box 22, some of the water flowing through the second channel 25 will enter the water holes 251 to mix with the detergent in the detergent box 22, and since the water stream inside the connector 2 has the propensity to eject forward, the mixture of water and detergent in the detergent box 22 is induced to flow out of the small holes 251 to be ejected from the spray head 11 for cleaning purposes.

I claim:

1. A cleaning device with a detergent control structure, comprising:

a tube that is an elongated hollow structure including a spray head fitted at a front end thereof and a plate having a cleaning element disposed thereon, said spray head having an I-shaped slide block extending from a lower portion thereof, said plate having a slide groove for receiving said slide block so that said plate can be coupled to the lower portion of said spray head;

a connector having one end fitted to a rear end of said tube, said connector including a screw portion extending from a lower portion thereof to couple to a detergent box containing a detergent, said connector being internally provided with a vertically disposed partition plate that divides the interior of said connector into first and second channels, said second channel being provided with small holes at front and rear ends thereof at suitable positions that communicate with said detergent box; and a control valve coupled to the other end of said connector and including a securing block and a rotary block, one end of said securing block being adhered directly to said connector, said securing block having a post of a suitable length extending from the other end adapted to fit into said rotary block that has the same external diameter as said securing block, a screw element being passed through said rotary block into said securing block so that said rotary block can be firmly connected to said securing block without slippage during relative rotation of said rotary block and said securing block, said securing block being further provided with first and second round holes respectively communicating with said first and second channels of said connector, said rotary block being provided with a round hole of a suitable diameter, a rear end of said rotary block being adhered directly to a hollow handle that has a rear end adapted to connect to a water hose, whereby water can enter via the water hose into said hollow handle that can be controlled to allow ejection of water or a mixture of water and detergent from said spray head to assist cleaning work.

2. A cleaning device with a detergent control structure as claimed in claim 1, wherein a plastic packing is disposed between said securing block and said rotary block to achieve water tightness.

3. A cleaning device with a detergent control structure as claimed in claim 1, wherein said securing block has two curved plates secured thereon using securing nails adapted to enclose said securing block and said rotary block and enhance the appearance of said control valve.

* * * * *